US007209080B2

(12) United States Patent
Crouch et al.

(10) Patent No.: US 7,209,080 B2
(45) Date of Patent: Apr. 24, 2007

(54) MULTIPLE-PORT PATCH ANTENNA

(75) Inventors: David D. Crouch, Corona, CA (US); Michael Sotelo, Chino, CA (US); William E. Dolash, Montclair, CA (US)

(73) Assignee: Raytheon Co., Waltham, MA (US)

( * ) Notice: Subject to any disclaimer, the term of this patent is extended or adjusted under 35 U.S.C. 154(b) by 191 days.

(21) Appl. No.: 10/883,093

(22) Filed: Jul. 1, 2004

(65) Prior Publication Data

US 2006/0007044 A1 Jan. 12, 2006

(51) Int. Cl.
*H01Q 1/38* (2006.01)
*H01Q 13/10* (2006.01)

(52) U.S. Cl. ..... 343/700 MS; 343/770

(58) Field of Classification Search ..... 343/770, 343/722, 746, 750, 751, 767, 844, 893, 908, 343/700 MS
See application file for complete search history.

(56) References Cited

U.S. PATENT DOCUMENTS 4,443,802 A * 4/1984 Mayes ..... 343/729
4,647,880 A * 3/1987 Argaman ..... 333/164
4,803,494 A * 2/1989 Norris et al. ..... 343/770
4,827,271 A * 5/1989 Berneking et al. ... 343/700 MS
4,972,196 A * 11/1990 Mayes et al. ..... 343/700 MS
5,515,057 A * 5/1996 Lennen et al. ..... 342/357.06
5,880,694 A 3/1999 Wang et al.
6,252,553 B1 * 6/2001 Solomon ..... 343/700 MS
6,262,683 B1 7/2001 Kawahata et al.
6,930,639 B2 * 8/2005 Bauregger et al. ... 343/700 MS
2004/0257287 A1 * 12/2004 Fukushima ..... 343/770

* cited by examiner

*Primary Examiner*—Don Wong
*Assistant Examiner*—Marie Antoinette Cabucos
(74) *Attorney, Agent, or Firm*—Thomas J. Finn; Leonard A. Alkov; Karl A. Vick

(57) ABSTRACT

A system and method for combining and radiating electromagnetic energy. The invention includes a novel antenna comprising a first dielectric substrate having opposite first and second surfaces, a patch of conducting material disposed on the first surface, a ground plane of conducting material disposed on the second surface, and at least three input ports, each input coupled to the patch at a feed point. The feed points are positioned to minimize the total power reflected from each input port. In an illustrative embodiment, the feed points are equally distributed around a circle having the same center as the patch and having a radius chosen to minimize the reflections at each input. In accordance with the novel method of the present invention, the outputs of multiple sources are combined in the antenna itself, by coupling the sources directly to the antenna.

48 Claims, 9 Drawing Sheets

MULTIPLE-PORT PATCH ANTENNA

BACKGROUND OF THE INVENTION

1. Field of the Invention

The present invention relates to electronics. More specifically, the present invention relates to microwave antennas and power combiners.

2. Description of the Related Art

Certain applications require the power from multiple microwave sources to be combined in order to create a single high-power output signal, which is then radiated by a single antenna. This is typically accomplished using one or more power combiners, such as microstrip power combiners, which combine the power from multiple amplifiers and feeds it to a conventional single- or two-port antenna using one or two microstrip lines. Power combiners, however, occupy a significant amount of circuit-board space. If the outputs of a large number of microwave sources are to be combined, the area occupied by power-combining circuitry can be a significant fraction of the total circuit board area. Problems can also occur with this power-combining approach for high-power applications since all the power is concentrated into one or two microstrip lines, which may be very narrow. If too much power is fed through the microstrip lines, it may cause an electrical breakdown.

Furthermore, these same applications sometimes require some degree of polarization diversity, i.e., the ability to radiate different polarizations (such as right- or left-handed circular polarization, or horizontal or vertical linear polarization) from a single antenna.

Choi et al., "A V-band Single-Chip MMIC Oscillator Array Using a 4-port Microstrip Patch Antenna," 2003 IEEE MTT-S Digest Volume 2, June 2003, pp. 881–884, describes an array of four field-effect transistor (FET) oscillators whose outputs are combined using a four-port patch antenna. Two parallel pairs of FET oscillators operating in a push-pull mode drive opposite sides of a rectangular patch antenna, which combines the outputs of the four oscillators and provides feedback due partly to impedance mismatches at each port, resulting in a strongly coupled system. That is, the antenna is an integral part of the oscillator array, and cannot be considered separately. This configuration is effective as a power combiner because the impedance mismatch is not detrimental to system operation. It cannot be used, however, if each port is to be driven by independent microwave sources or if circularly polarized radiation is desired.

U.S. Pat. No. 5,880,694 issued to Wang et al. discloses a phased-array antenna using a stacked-disk radiator. Two orthogonal pairs of excitation probes are coupled to a lower excitable disk. The polarization of the antenna can be single linear polarization, dual linear polarization, or circular polarization, depending on whether a single pair or two pairs of excitation probes are excited. This antenna, however, cannot be used as a power combiner for multiple sources.

U.S. Pat. No. 6,549,166 issued to Bhattacharyya et al. discloses a four-port patch antenna capable of generating circularly-polarized radiation. This antenna comprises a radiating patch, a ground plane having at least four slots placed under the radiating patch, at least four feeding circuits (one for each slot), and a hybrid network each of whose outputs feed one of the feed networks and having a right-hand circularly polarized input port, a left-hand circularly polarized input port, and two matched terminated ports. The input impedances at the individual ports of the antenna need not be matched to those of the feed lines; the two matched terminated ports of the hybrid network absorb most of the energy reflected by the antenna, increasing the return loss at the input port. Use of the hybrid network prevents use of the antenna for combining the outputs of more than two microwave sources. In addition, the hybrid network requires a significant area for implementation.

Hence, there is a need in the art for an improved system or method for combining the power from multiple microwave sources that reduces the need for conventional power-combining circuitry and is suitable for high-power applications and for radiating microwave energy with greater polarization diversity than prior art systems.

SUMMARY OF THE INVENTION

The need in the art is addressed by the system and method for combining and radiating electromagnetic energy of the present invention. The invention includes a novel antenna comprising a first dielectric substrate having opposite first and second surfaces, a patch of conducting material disposed on the first surface, a ground plane of conducting material disposed on the second surface, and at least three input ports, each input coupled to the patch at a feed point. The positions of the feed points and the size of the patch are chosen to minimize the total power reflected from each input port. In an illustrative embodiment, the feed points are equally distributed around a circle of radius d having the same center as a circular patch of radius a, where d and a are chosen to minimize the reflections at each input. In accordance with the novel method of the present invention, the outputs of multiple sources are combined in the antenna itself, by coupling the sources directly to the antenna. The antenna can radiate right-handed circular polarization, left-handed circular polarization, or any desired linear polarization when driven by the appropriate set of inputs.

BRIEF DESCRIPTION OF THE DRAWINGS

FIG. 1*a* shows a three-dimensional view, FIG. 1*b* shows a side view, FIG. 1*c* shows a front view, and FIG. 1*d* shows a back view.

FIG. 8*a* shows a normal view and FIG. 8*b* shows an exploded view.

FIG. 9*a* shows a normal view and FIG. 9*b* shows an exploded view.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

The present invention eliminates the need to pre-combine the outputs of multiple microwave sources by providing a patch antenna with multiple input ports. The power sources are coupled directly to the antenna, and the power is combined in the antenna itself, rather than using separate circuit-based power combiners. The area that would otherwise be occupied by power combiners can be eliminated or used for other purposes. The total radiated power is spread over a much larger volume than if a single feed were to be used, reducing the possibility of overheating or electrical breakdown due to excessively high fields. The invention uses reflection cancellation to increase the return loss at each input port. By properly locating the feed points, the direct reflections from the individual ports are cancelled by the signals coupled from the other ports, eliminating the need for additional impedance-matching circuitry. Furthermore, a single multiple-port patch antenna designed in accordance with the present teachings can radiate right-handed circular polarization, left-handed circular polarization, or any desired linear polarization when driven by the appropriate set of inputs.

Figure 1A:
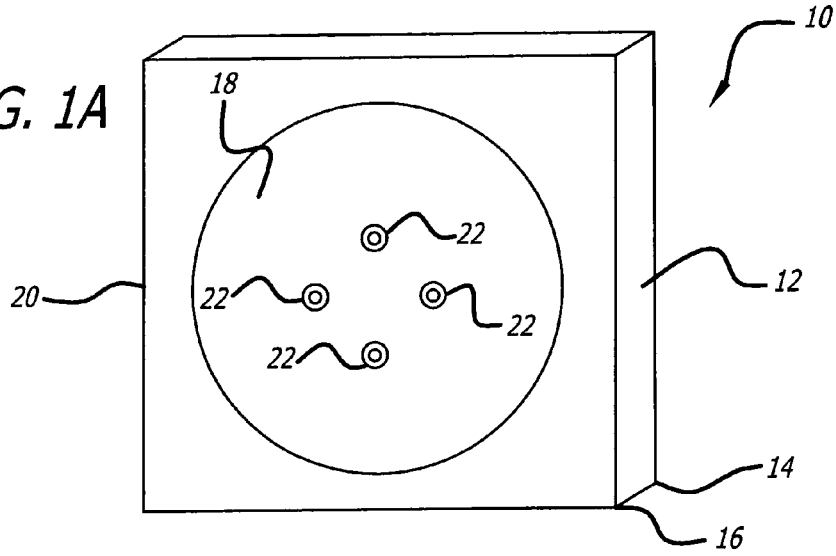
FIGS. 1*a*–1*d* are diagrams of a four-port implementation of an antenna designed in accordance with an illustrative embodiment of the teachings of the present invention.
Figure 1B:
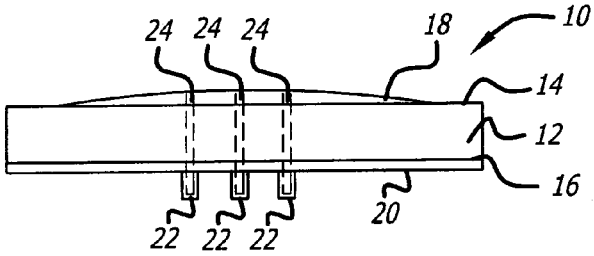
Figure 1C:
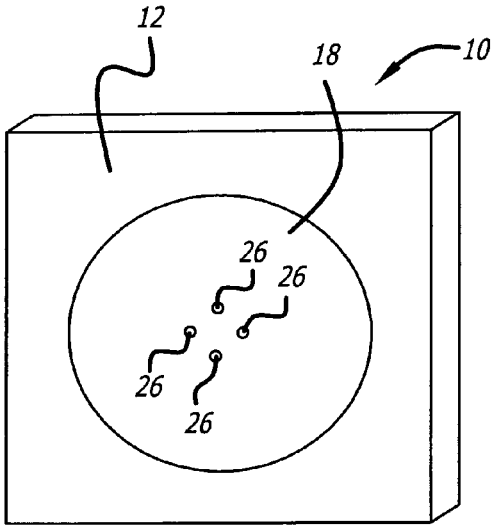
Figure 1D:
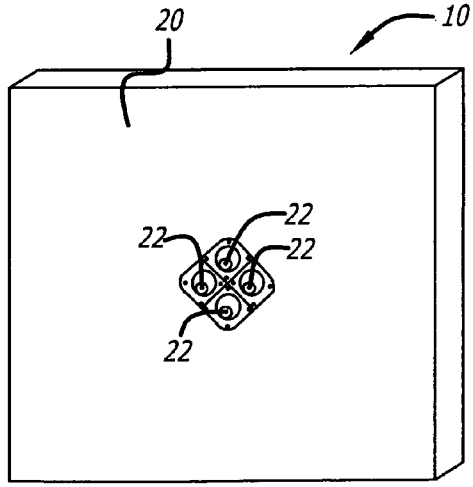

FIGS. 1*a*–1*d* are diagrams of a four-port implementation of an antenna 10 designed in accordance with an illustrative embodiment of the teachings of the present invention. FIG. 1*a* shows a three-dimensional view, FIG. 1*b* shows a side view, FIG. 1*c* shows a front view, and FIG. 1*d* shows a back view. The assembled antenna 10 includes a microstrip patch antenna and at least three input ports 22. The patch antenna 10 is comprised of a dielectric substrate 12 with opposite first and second surfaces 14 and 16, a patch 18 of conducting material disposed on the first surface 14, and a ground plane 20 of conducting material disposed on the second surface 16. Note that in FIG. 1*b*, the thickness of the patch 18 and ground plane 20 are exaggerated for illustrative purposes. The patch itself can be fabricated using conventional printed-circuit etching techniques.

In the illustrative embodiment of FIGS. 1*a*–1*d*, the patch 18 is circular. The size of the patch 18 is determined primarily by the desired frequency of operation. It is well known that the resonant frequencies of a circular patch of radius a are approximated by:

$$f = \frac{\chi'_{mn} c}{2\pi a \sqrt{\mu_r \varepsilon_r}} \quad [1]$$

where $\chi'_{mn}$ represents the $n^{th}$ zero of the derivative of the $m^{th}$-order Bessel function $J_m(x)$ of the first kind [i.e., $J'_{mn}(\chi'_{mn})=0$]. The frequency of interest is the lowest-order resonant frequency for which m=1, n=1, and $\chi'_{11}=1.841$. For example, if $\mu_r=1$, $\epsilon_r=2.2$, and f=1.03 GHz, the patch radius should be a=2.264 inches.

A plurality of input ports 22 are coupled to the patch 18. In the illustrative embodiment of FIGS. 1*a*–1*d*, the antenna 10 is fed by four coaxial ports 22, each attached directly to its feed point 26, i.e., the point at which the center conductor 24 of the coaxial port 22 is attached to the patch 18. The outer conductors of the coaxial ports 22 are connected to the ground plane 20.

Figure 2:
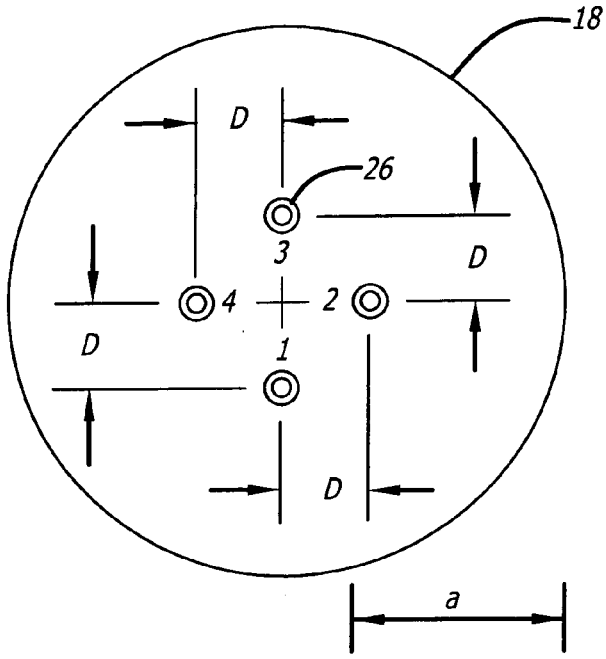
FIG. 2 is a diagram showing the location of the feed points in a circular patch in accordance with an illustrative embodiment of the teachings of the present invention.

FIG. 2 is a diagram showing the location of the feed points 26 in a circular patch 18 of radius a. In this embodiment, each input port 22 is placed directly opposite of its feed point 26, with the feed points 26 on the patch side 14 of the substrate 12 and the input ports 22 on the other side 16 of the substrate 12. In accordance with the teachings of the present invention, the feed points 26 are equally distributed around a circle of radius d having the same center as the patch 18. In FIG. 2, the four feed points are labeled 1, 2, 3, and 4, with port 1 opposite port 3, and port 2 opposite port 4.

Proper choice of patch size and proper placement of the feed points are the most critical elements in the design and construction of the present invention. With a single-port patch antenna, the return loss is maximized by placing the port at the proper distance from the center of the patch. With a four-port patch antenna, one cannot simply place the ports in the same locations they would occupy in a one-port design, since there is cross-coupling between ports that is not present in a single-port design. That is, if all four ports are excited simultaneously, the reflected wave at port 1, for example, is composed of contributions from all four ports: a directly-reflected wave from port 1, and cross-coupled waves from ports 2, 3, and 4.

In accordance with the teachings of the present invention, the feed points are placed so that the sum of the directly-reflected and cross-coupled waves is very small, i.e., the direct reflection from port 1 is nearly cancelled by the cross-coupled waves from ports 2, 3, and 4. By this reflection-cancellation technique, each port is matched without the need for additional impedance-matching elements.

If the amplitudes of the incident waves at the four ports are denoted $A_1$, $A_2$, $A_3$, and $A_4$, the amplitudes of the reflected waves $B_1$, $B_2$, $B_3$, and $B_4$ at each of the four ports are given by:

$$\begin{bmatrix} B_1 \\ B_2 \\ B_3 \\ B_4 \end{bmatrix} = \begin{bmatrix} S_{11} & S_{12} & S_{13} & S_{14} \\ S_{21} & S_{22} & S_{23} & S_{24} \\ S_{31} & S_{32} & S_{33} & S_{34} \\ S_{41} & S_{42} & S_{43} & S_{44} \end{bmatrix} \begin{bmatrix} A_1 \\ A_2 \\ A_3 \\ A_4 \end{bmatrix} \quad [2]$$

where the elements $S_{ij}$ are the S parameters for the four-port patch antenna. If it is desired to radiate circular polarization, then the inputs at each port must be of nearly equal amplitude and 90° out of phase with those of its immediate neighbors. For example, let:

$$A_1=e^{j0}=1=1\angle 0°,$$

$$A_2=e^{j\pi/2}=j=1\angle 90°,$$

$$A_3=e^{j\pi}=-1=1\angle 180°,$$

$$A_4=e^{j3\pi/2}=-j=1\angle 270°; \quad [3]$$

This set of inputs will yield a right-hand circularly-polarized (RHCP) output. To obtain a left-hand circularly-polarized (LHCP) output, simply let $A_2=-j$ and $A_4=j$ in Eqn. (3). The amplitude of the reflected wave at port 1 for the inputs given in Eqn. (3) is then given by:

$$\begin{aligned} B_1 &= S_{11}A_1 + S_{12}A_2 + S_{13}A_3 + S_{14}A_4 \\ &= S_{11} + jS_{12} - S_{13} - jS_{14} \\ &= S_{11} - S_{13} + j(S_{12} - S_{14}). \end{aligned} \quad [4]$$

Clearly, the amplitude of the reflected wave will be identically equal to zero if the following conditions are satisfied:

$$S_{11}=S_{13},$$

$$S_{12}=S_{14}. \quad [5]$$

Since both the antenna and the placement of the ports are symmetric, as shown in FIG. 2, identical conditions will hold at the three remaining ports. Moreover, the symmetry of the patch and the port placement guarantees that the coupling from port 2 to port 1 is nearly identical to that from port 4 to port 1, so that $S_{12}\cong S_{14}$. Therefore, reflections can be minimized by choosing the proper distance d from the center of the patch at which to place each of the four ports so that $|S_{11}-S_{13}|$ is minimized.

Figure 3:
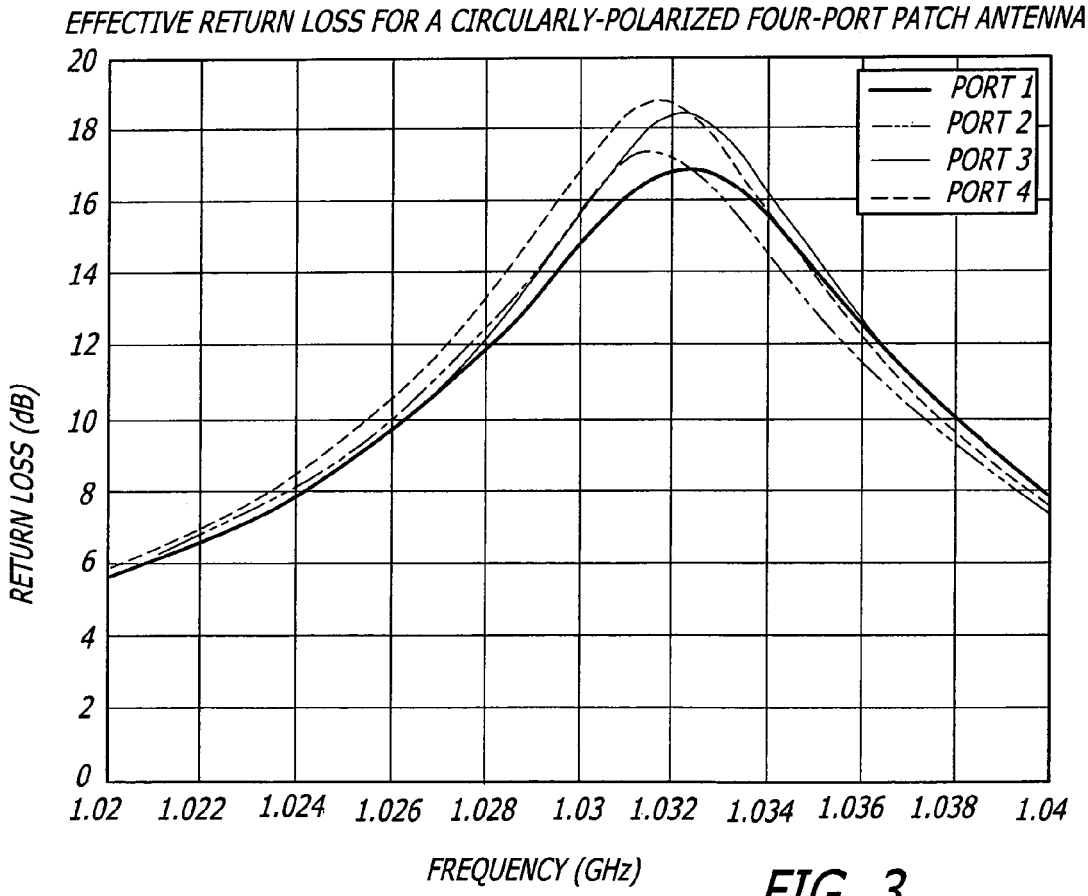
FIG. 3 is a graph of measured effective return loss vs. frequency in a prototype four-port antenna designed in accordance with an illustrative embodiment of the teachings of the present invention.

A prototype four-port patch antenna was designed to operate at a frequency of f=1.03 GHz. Eqn. 1 was used to calculate a starting value of $a_0$=2.264 inches for the patch radius. The distances d and a were determined iteratively. For the four-port patch shown in FIGS. 1*a*–1*d*, the best parameters were found to be a=2.198 inches and d=0.380 inches. This design was fabricated and its S parameters were measured using a network analyzer. FIG. 3 is a graph of measured effective return loss vs. frequency in the prototype four-port antenna, in which the amplitude of the reflected wave at each port is calculated using Eqn. 2 with the set of inputs given in Eqn. 3. The effective return loss is the magnitude of the ratio of the reflected power to the incident power, measured on a logarithmic scale:

$$\text{Return Loss at Port } n = -20\log_{10}|R_n| = -20\log_{10}\left|\frac{B_n}{A_n}\right|. \quad [6]$$

Note that the center frequency is approximately 2 MHz too high, and the worst-case return loss is slightly less than 15 dB at the center frequency. Further design refinements can be made to correct the center frequency and increase the return loss at the center frequency.

By choosing a different set of input phases, the same design can also be made to radiate a linearly-polarized wave. Suppose that the inputs are given by:

$$A_1=e^{j0}=1,$$

$$A_2=e^{j0}=1,$$

$$A_3=e^{j\pi}=-1,$$

$$A_4=e^{j\pi}=-1. \quad [7]$$

In this case, the amplitude of the reflected wave at port 1 is:

$$\begin{aligned} B_1 &= S_{11}A_1 + S_{12}A_2 + S_{13}A_3 + S_{14}A_4 \\ &= S_{11} - S_{13} + S_{12} - S_{14} \\ &\approx S_{11} - S_{13} \end{aligned} \quad [8]$$

since $S_{12}\cong S_{14}$ ($S_{12}$ and $S_{14}$ will be nearly equal in a real antenna). This is the same matching condition as for circular polarization, so the same antenna will radiate either polarization with the appropriate change in input phases.

Figure 4A:
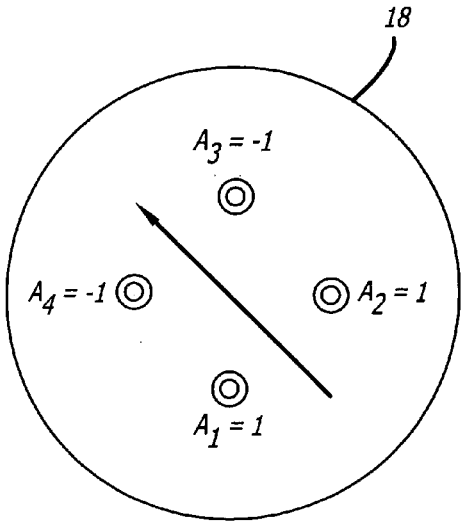
FIGS. 4*a* and 4*b* are illustrations showing the two orthogonal linearly polarized outputs and the corresponding inputs of a four-port antenna designed in accordance with an illustrative embodiment of the teachings of the present invention.
Figure 4B:
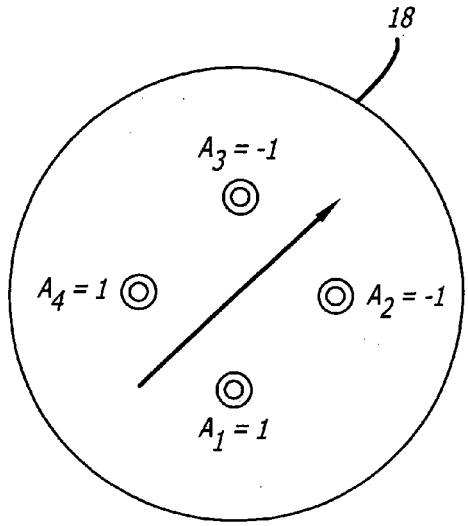

In fact, the antenna can radiate either of two orthogonal linear polarizations, depending on the phases of the inputs. FIGS. 4*a* and 4*b* illustrate the two orthogonal linearly polarized outputs and the corresponding inputs as seen viewed from the back of the antenna. In FIG. 4*a*, the inputs are given by Eqn. 6 and the output polarization is in the direction from port 1 to port 4. In FIG. 4*b*, $A_1=1$, $A_2=-1$, $A_3=-1$, and $A_4=1$and the output polarization is in the direction from port 1 to port 2.

Figure 5A:
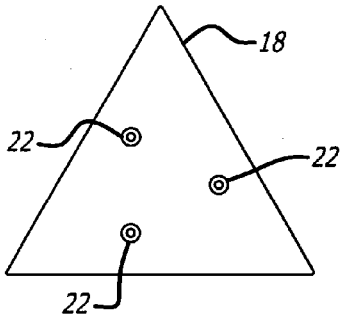
FIG. 5*a* is a diagram of an illustrative embodiment of the present invention with an equilateral triangular patch and three input ports.

The present invention is not limited to patches that are circular in shape with four ports. Patches of other shapes may be used without departing from the scope of the present teachings. Furthermore, the invention may have any number of input ports greater than two. FIG. 5*a* is a diagram of an illustrative embodiment of the present invention with an equilateral triangular patch 18 with three ports 22. The ports 22 can be placed at 120° intervals on a circle centered on the center of the patch, as illustrated in FIG. 5*a*. Notice that the triangle whose vertices are the three ports 22 is rotated with respect to the patch 18. It is not necessary that the ports be placed along the bisectors of each side or along the bisectors of each angle.

Figure 5B:
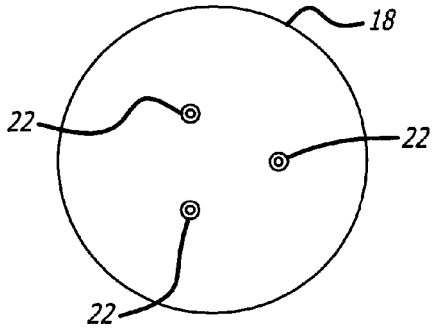
FIG. 5*b* is a diagram of an illustrative embodiment of the present invention with a circular patch and three input ports.

In this geometry, each port 22 sees exactly the same environment as the other two ports, so that if one port is matched, all the ports are matched. The same is true of the antenna shown in FIG. 5*b*, in which the triangular patch has been replaced by a circular patch.

In general, an N-port patch antenna can be constructed by utilizing a suitable geometric figure having N-fold rotational symmetry; that is, a figure that is invariant when rotated about its axis of symmetry by any integer multiple of 360/N degrees. A special case is a circle, which is invariant under any rotation about its center. Design of such an N-port patch antenna is greatly simplified when the geometry "seen" by each port is the same, for if one port is matched, all of the ports are matched. This condition is satisfied by distributing the ports at equal intervals around a circle centered on the axis of symmetry of the patch. In the case of a circular patch, the ports are equally distributed around a circle having the same center as the patch.

Figure 6:
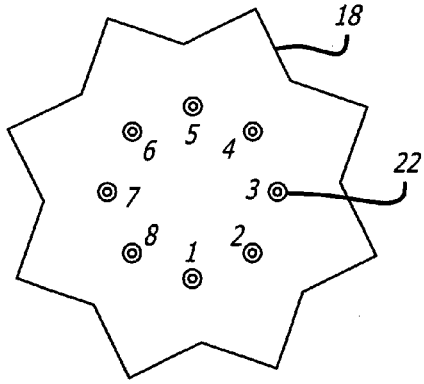
FIG. 6 is a diagram of an illustrative embodiment of the present invention with a sixteen-sided patch and eight input ports.

As an example, consider an 8-port patch antenna constructed from a 16-sided polygon with ports arranged as shown in FIG. 6. The ports 22 are located every 45° on a circle of radius d centered on the polygon's axis of rotational symmetry. The ports 22 are labeled 1 through 8, with port 1 opposite port 5, port 2 opposite 6, port 3 opposite port 7, and port 4 opposite port 8. The patch geometry and the radius d are chosen to minimize the total power reflected from each port. By properly choosing the phases at the input ports, the antenna can be made to radiate either left-hand circular polarization (LHCP) or right-hand circular polarization (RHCP). The following is a set of inputs for RHCP:

$$A_1=Ae^{j0}=A\angle 0°,$$

$$A_2=Ae^{j\pi/4}=A\angle 45°,$$

$$A_3=Ae^{j2\pi/4}=Ae^{j\pi/2}=jA=A\angle 90°,$$

$$A_4=Ae^{j3\pi/4}=A\angle 135°,$$

$$A_5=Ae^{j4\pi/4}=Ae^{j\pi}=-A=A\angle 180°,$$

$$A_6=Ae^{j5\pi/4}=A\angle 225°,$$

$$A_7=Ae^{j6\pi/4}=Ae^{j3\pi/2}=A\angle 270°,$$

$$A_8=Ae^{j7\pi/4}=A\angle 315°. \quad [9]$$

The following inputs can be used for LHCP:

$$A_1=Ae^{j0}=A\angle 0°,$$

$$A_2=Ae^{j7\pi/4}=A\angle 315°,$$

$$A_3=Ae^{j6\pi/4}=Ae^{j3\pi/2}=-jA=A\angle 270°,$$

$$A_4=Ae^{j5\pi/4}=A\angle 225°,$$

$$A_5=Ae^{j4\pi/4}=Ae^{j\pi}=-A=A\angle 180°,$$

$$A_6=Ae^{j3\pi/4}=A\angle 135°,$$

$$A_7=Ae^{j2\pi/4}=Ae^{j\pi/2}=A\angle 90°,$$

$$A_8=Ae^{j\pi/4}=A\angle 45°, \quad [10]$$

For example, for the set of inputs yielding a RHCP output, the total reflected wave at port 1 is given by:

$$\begin{aligned} B_1 &= S_{11}A_1 + S_{12}A_2 + S_{13}A_3 + S_{14}A_4 + S_{15}A_5 + S_{16}A_6 + S_{17}A_7 + S_{18}A_8 \\ &= A(S_{11} + e^{j\pi/4}S_{12} + e^{j\pi/2}S_{13} + e^{j3\pi/4}S_{14} - S_{15} - e^{j\pi/4}S_{16} - e^{j\pi/2}S_{17} - e^{j3\pi/4}S_{18}) \\ &= A[(S_{11} - S_{15}) + e^{j\pi/4}(S_{12} - S_{16}) + e^{j\pi/2}(S_{13} - S_{17}) + e^{j3\pi/4}(S_{14} - S_{18})]. \end{aligned} \quad [11]$$

To minimize the reflected wave amplitude, the antenna must be designed to minimize:

$$\begin{aligned} R_1 &= \frac{B_1}{A} \\ &= (S_{11} - S_{15}) + e^{j\pi/4}(S_{12} - S_{16}) + e^{j\pi/2}(S_{13} - S_{17}) + e^{j3\pi/4}(S_{14} - S_{18}). \end{aligned} \quad [12]$$

The procedure by which this is achieved is similar to that for the four-port circular patch described earlier.

In general, for an antenna having N ports, the phases at the input to each port should be increased in increments of 360/N degrees, proceeding from port to port in either a clockwise direction, to yield a left-hand circularly-polarized radiated wave, or in a counter-clockwise direction, to yield a right-hand circular-polarized radiated wave.

Thus, the eight-port patch antenna can radiate both right-hand and left-hand circular polarization. Since a linearly-polarized wave is simply the superposition of two equal-amplitude circularly polarized waves of opposite helicity, a vertically-polarized output can be obtained by driving the antenna with the same superposition of inputs that yield the corresponding circularly-polarized waves, as given by the following:

$$\begin{aligned} A_{V1} &= \frac{1}{2}(A_1^{LHCP} + A_1^{RHCP}) = 1, \\ A_{V2} &= \frac{1}{2}(A_2^{LHCP} + A_2^{RHCP}) = \frac{1}{\sqrt{2}}, \\ A_{V3} &= \frac{1}{2}(A_3^{LHCP} + A_3^{RHCP}) = 0, \\ A_{V4} &= \frac{1}{2}(A_4^{LHCP} + A_4^{RHCP}) = -\frac{1}{\sqrt{2}}, \\ A_{V5} &= \frac{1}{2}(A_5^{LHCP} + A_5^{RHCP}) = -1, \\ A_{V6} &= \frac{1}{2}(A_6^{LHCP} + A_6^{RHCP}) = -\frac{1}{\sqrt{2}}, \\ A_{V7} &= \frac{1}{2}(A_7^{LHCP} + A_7^{RHCP}) = 0, \\ A_{V8} &= \frac{1}{2}(A_8^{LHCP} + A_8^{RHCP}) = \frac{1}{\sqrt{2}}, \end{aligned} \quad [13]$$

Figure 7A:
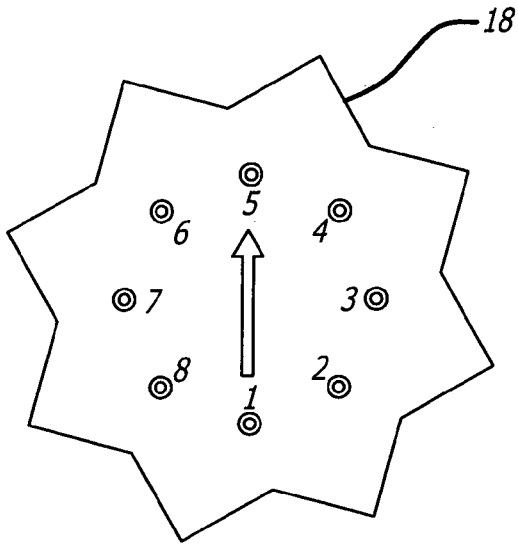
FIGS. 7*a* and 7*b* are illustrations showing the two orthogonal linearly polarized outputs of an eight-port antenna illustrative of the teachings of the present invention.

FIG. 7*a* is a diagram of an eight-port patch antenna with the inputs given by Eqn. 13. The output is linearly polarized in the direction from port 1 to port 5 (vertically in FIG. 7*a*).

Horizontal linear polarization is obtained from the same set of inputs simply by rotating the inputs by 90° clockwise or counter clockwise with respect to ports 1 through 8, as given by:

$$\begin{aligned} A_{H1} &= A_{V7} = 0, & A_{H5} &= A_{V3} = 0, \\ A_{H2} &= A_{V8} = \frac{1}{\sqrt{2}}, & A_{H6} &= A_{V4} = -\frac{1}{\sqrt{2}}, \\ A_{H3} &= A_{V1} = 1, & A_{H7} &= A_{V5} = -1, \\ A_{H4} &= A_{V2} = \frac{1}{\sqrt{2}}, & A_{H8} &= A_{V6} = -\frac{1}{\sqrt{2}}. \end{aligned} \quad [14]$$

Figure 7B:
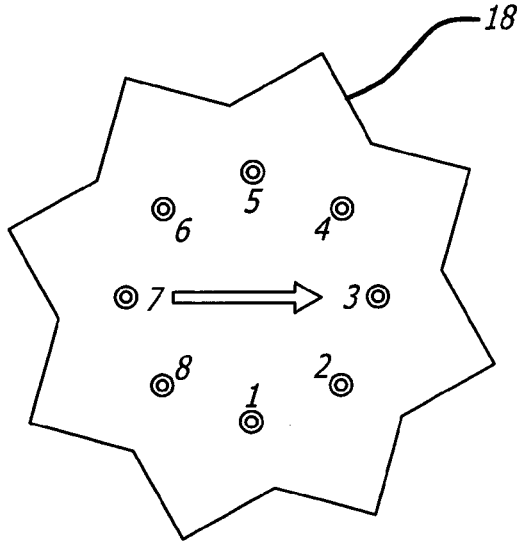

FIG. 7*b* is a diagram of an eight-port patch antenna with the inputs given by Eqn. 14. The output is linearly polarized in the direction from port 7 to port 3.

The condition that all ports see the same geometry simplifies the design of the multiple-port patch antenna, but it is not a requirement. Other antenna configurations in which different ports see different geometries may be used without departing from the scope of the present teachings.

In the illustrative embodiment of FIGS. 1*a*–1*d*, the antenna is fed by four coaxial ports, each attached directly to its feed point. This configuration may be inconvenient in some cases in that the feed points are so close together that any connectors will interfere with each other. Other configurations for feeding the antenna may be used without departing from the scope of the present teachings.

Figure 8A:
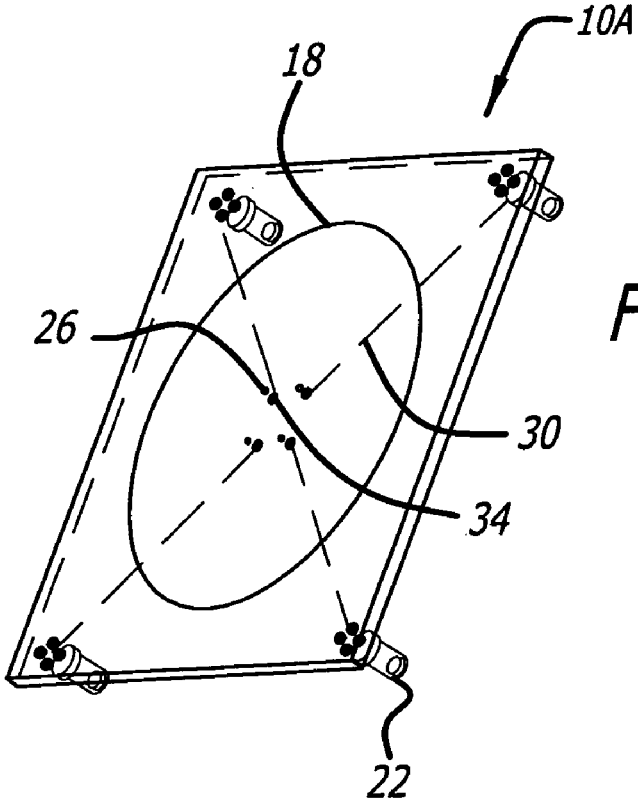
FIGS. 8*a* and 8*b* are diagrams of an illustrative embodiment of an antenna of the present invention with an alternative method for feeding the antenna.
Figure 8B:
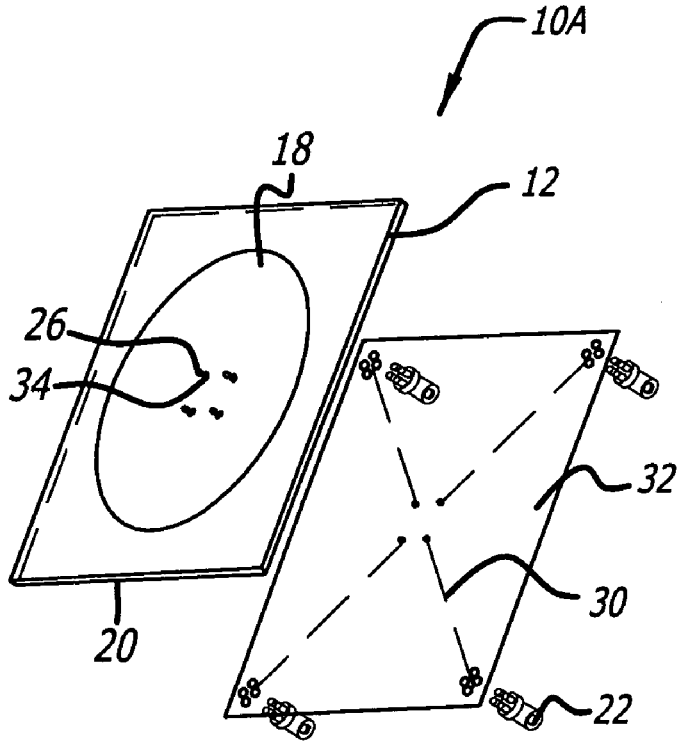

FIGS. 8*a* and 8*b* are diagrams of an illustrative embodiment of an antenna 10A of the present invention with an alternative method for feeding the antenna that decouples the feed points from the location of the input ports. FIG. 8*a* shows a normal view and FIG. 8*b* shows an exploded view. In this configuration, the patch 18 lies on one outer face of a two-layer circuit, and a microstrip feed network 30 lies on the other face. The patch 18 lies on a first surface of a first dielectric substrate 12, and a ground plane 20 lies on the second surface of the first dielectric substrate 12. A first surface of a second dielectric substrate 32 lies on the ground plane 20, and the microstrip feed network 30 lies on the second surface of the second dielectric substrate 32. Thus, the patch antenna 18 and the microstrip feed network 30 share a common ground plane. Each port 22 (i.e., the coaxial connector) makes a transition to microstrip. A microstrip transmission line 30 then carries the energy delivered by the port 22 to a point directly under the corresponding feed point 26 on the antenna 18. At this point, a metallic probe 34 carries the energy from the microstrip transmission line 30 through a hole in the common ground plane 20 to the feed point 26 on the lower surface of the patch 18.

There are several advantages to this method of feeding the antenna. First, it allows scaling the multiple-port patch antenna to all frequencies, as one no longer need be concerned with mechanical interference between adjacent connectors at high frequencies (where the distance between feed points is smaller than the size of the connectors). It also allows one to make use of the area on the microstrip-feed side of the board for circuitry. For example, if it is required to protect the microwave sources feeding the antenna from large reflections, surface-mount isolators can be mounted on the back of the antenna, possibly eliminating the need for a circuit board elsewhere in a larger system.

Figure 9A:
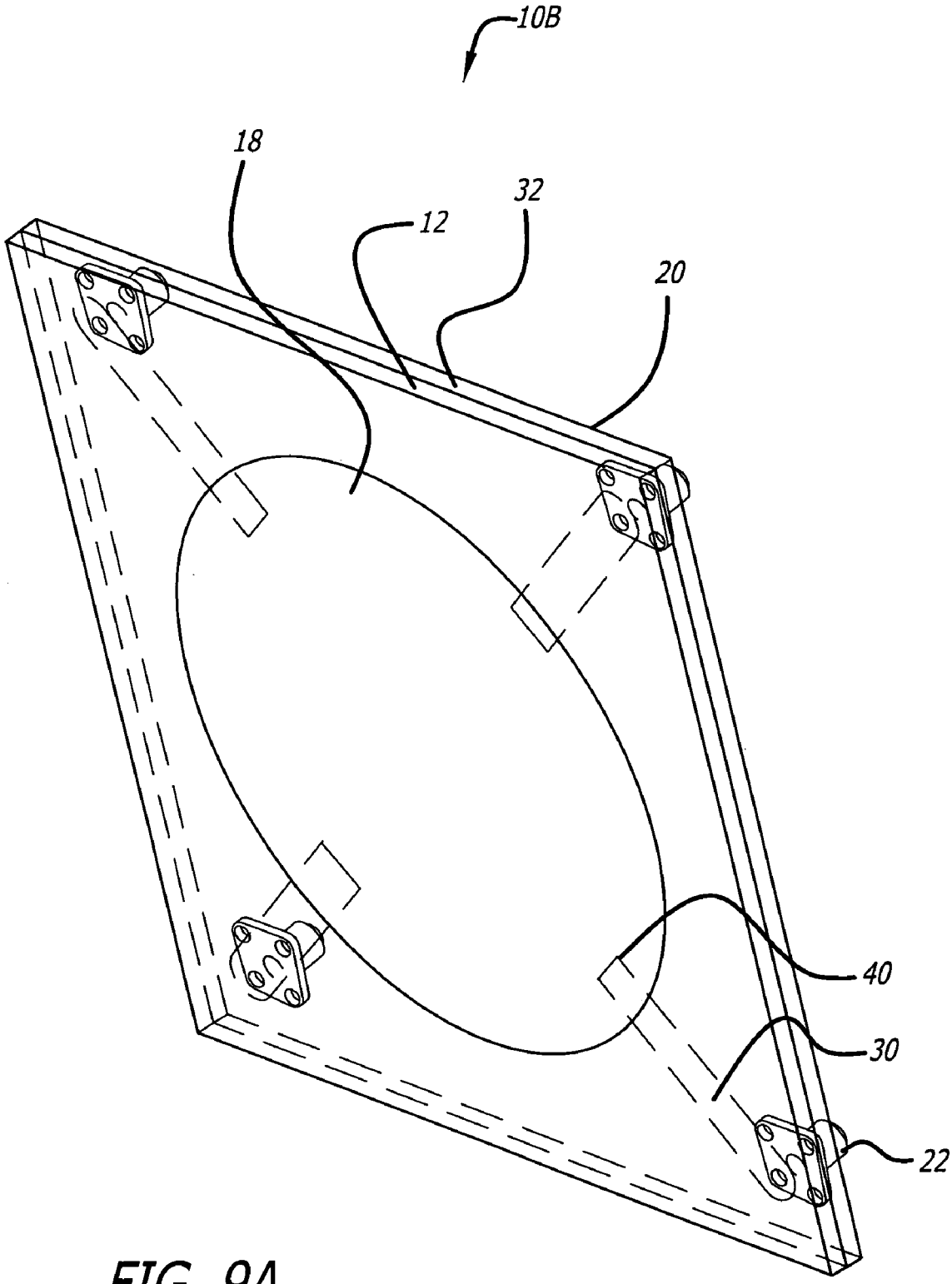
FIGS. 9*a* and 9*b* are diagrams showing the current best mode embodiment of the present invention.
Figure 9B:
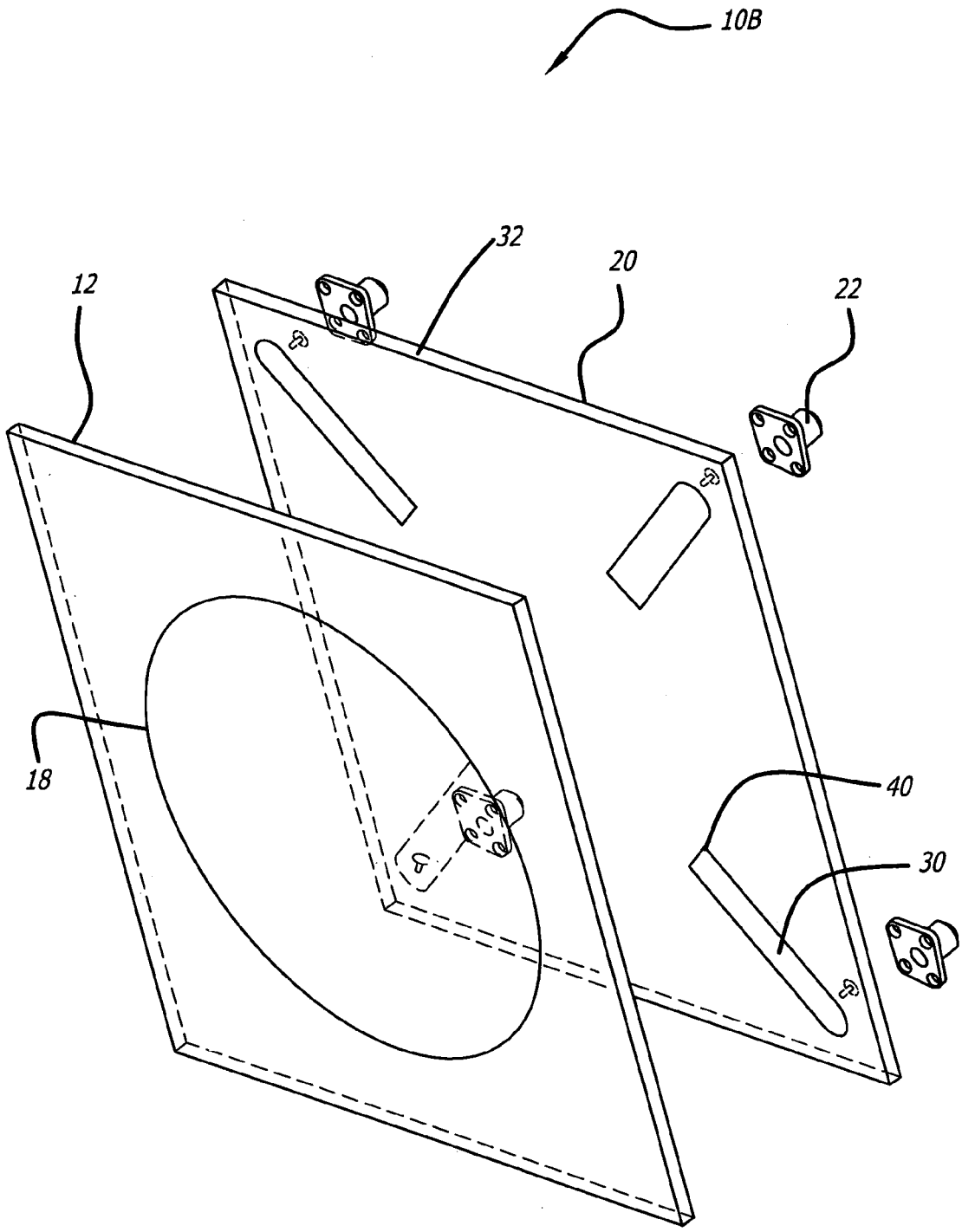

FIGS. 9*a* and 9*b* are diagrams showing the current best mode embodiment of the invention. FIG. 9*a* shows a normal view and FIG. 9*b* shows an exploded view of a four-port version of the multiple-port patch antenna. The antenna 10B includes two dielectric substrates 12 and 32. The patch 18 (which is circular in this example) is disposed on a first surface of the first dielectric substrate 12. The second surface of the first substrate 12 faces a first surface of the second substrate 32. The ground plane 20 is disposed on the second surface of the second substrate 32. The coaxial connectors 22 feed microwave energy to microstrip feed lines 30 that are sandwiched between the two dielectric substrates 12 and 32. The four coaxial connectors 22 are attached to the ground plane 20, arranged in a circle around the circular patch 18. The center conductors of the coaxial ports 22 are each connected to a microstrip feed line 30. For each coaxial port 22, the distance of the point of connection from the end of the corresponding microstrip feed line 30 is chosen to minimize the reflected power from the coaxial-to-microstrip transition. The microstrip feed lines 30 carry the microwave signal to the ends of the feed lines 40, where it is radiated into the volume between the patch 18 and the ground plane 20. The locations of the ends of the feed lines 40 are determined in a similar manner as described above for the feed points 26 in the other embodiments. In this example, the ends of the feed lines 40 are equally distributed around a circle having the same center as the patch 18.

Figure 10:
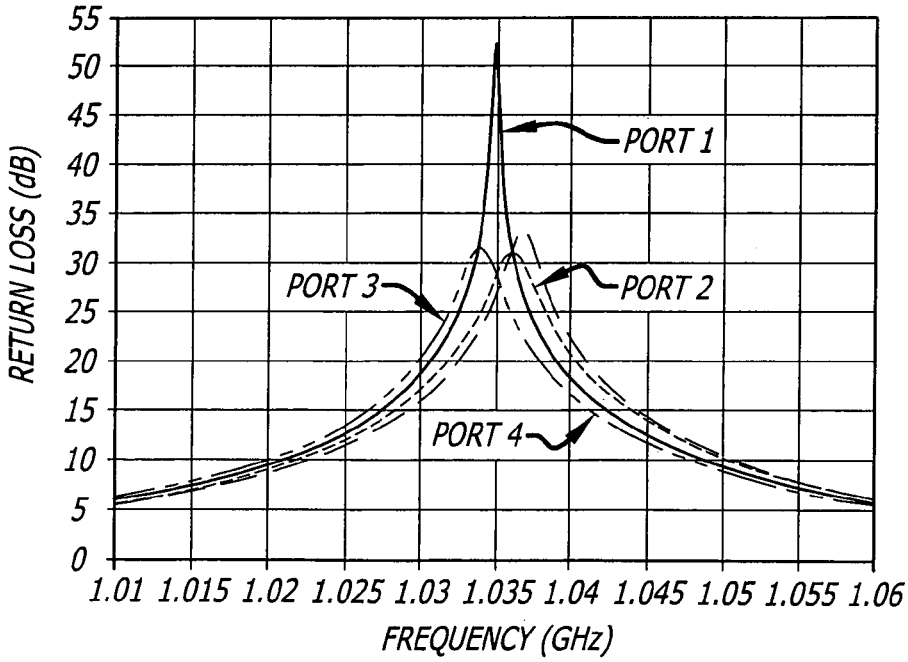
FIG. 10 is a graph of measured effective return loss vs. frequency in a prototype four-port antenna designed in accordance with an illustrative embodiment of the teachings of the present invention.

A prototype four-port patch antenna utilizing the best-mode embodiment was constructed. The design procedure is the same as that for the four-port circular patch described earlier. For the four-port patch shown in FIGS. 9*a* and 9*b*, the radius a of the circular patch 18 is 2.073 inches, and the ends of each of the four microstrip feed lines 30 are arranged on a circle of radius 1.72 inches. Both the first substrate 12 and the second substrate 32 are 0.125 inches thick and have a dielectric constant of 2.2. FIG. 10 is a graph of the measured effective return loss vs. frequency of each port of the prototype four-port patch antenna. Note that the center frequency is approximately 5 MHz too high, and the worst-case return loss is approximately 27 dB at the center frequency. Further design refinements can be made to correct the center frequency and to reduce the spread in the center frequencies of the individual ports.

Figure 11A:
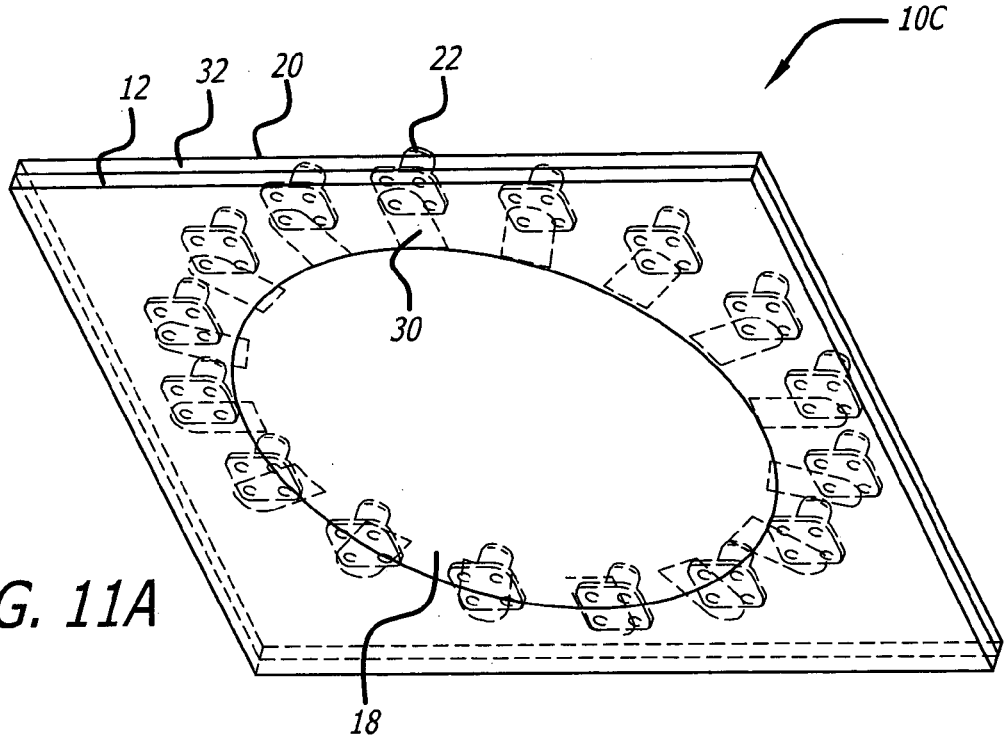
FIGS. 11*a* and 11*b* are diagrams of a sixteen-port version of the antenna designed in accordance with an illustrative embodiment of the teachings of the present invention.
Figure 11B:
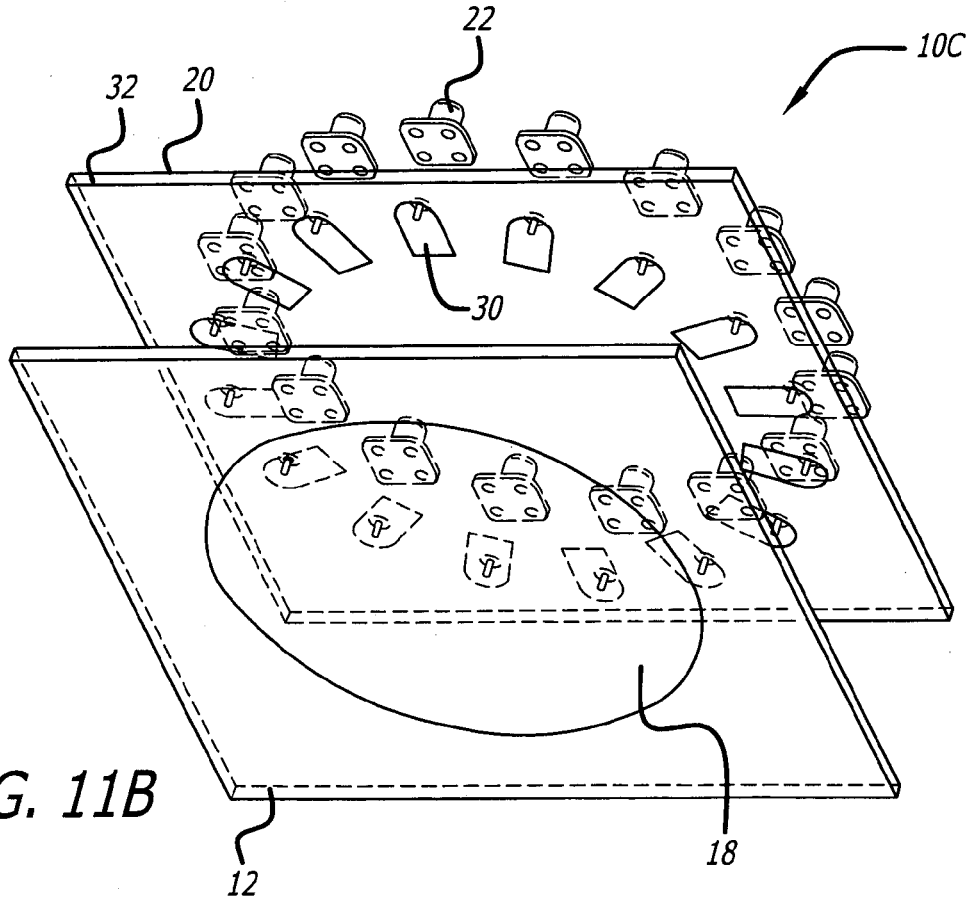

FIGS. 11*a* and 11*b* are diagrams of a sixteen-port version of the antenna designed in accordance with an illustrative embodiment of the teachings of the present invention. FIG. 11*a* shows a normal view and FIG. 11*b* shows an exploded view. The antenna 10C is similar to that of FIGS. 10*a* and 10*b*, except having sixteen ports 22 and microstrip feed lines 30. This antenna is designed to radiate a circularly-polarized wave. To achieve this, the phases at the input to each port increase in increments of 22.5 degrees; that is, if port 1 is 0 degrees (where any port can be chosen as port 1), then the phase at the input to port 2 should be 22.5 degrees, the input to port 3 should be 45 degrees, etc., proceeding from port to port in either a clockwise direction, which will yield a left-hand circularly-polarized radiated wave, or in a counter-clockwise direction, which will yield a right-hand circular-polarized radiated wave.

Figure 12:
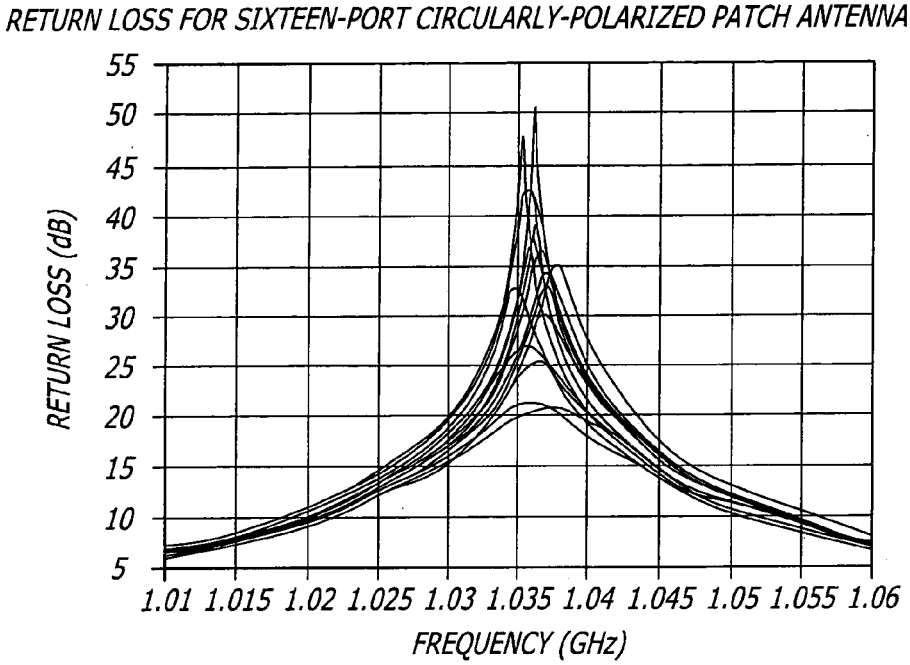
FIG. 12 is a graph of measured effective return loss vs. frequency in a prototype sixteen-port antenna designed in accordance with an illustrative embodiment of the teachings of the present invention.

A prototype sixteen-port patch antenna was constructed using the design shown in FIGS. 11*a* and 11*b*. For the sixteen-port patch shown in FIGS. 11*a* and 11*b*, the radius a of the circular patch 18 is 2.023 inches, and the ends of each of the sixteen microstrip feed lines 30 are arranged on a circle of radius 1.908 inches. Both the first substrate 12 and the second substrate 32 are 0.125 inches thick and have a dielectric constant of 2.2. FIG. 12 is a graph of the measured effective return loss vs. frequency of each port of the prototype sixteen-port patch antenna. Note that the center frequency is approximately 7 MHz too high, and the worst-case return loss is approximately 21 dB at the center frequency. Further design refinements can be made to correct the center frequency and to reduce the spread in the center frequencies of the individual ports.

Figure 13:
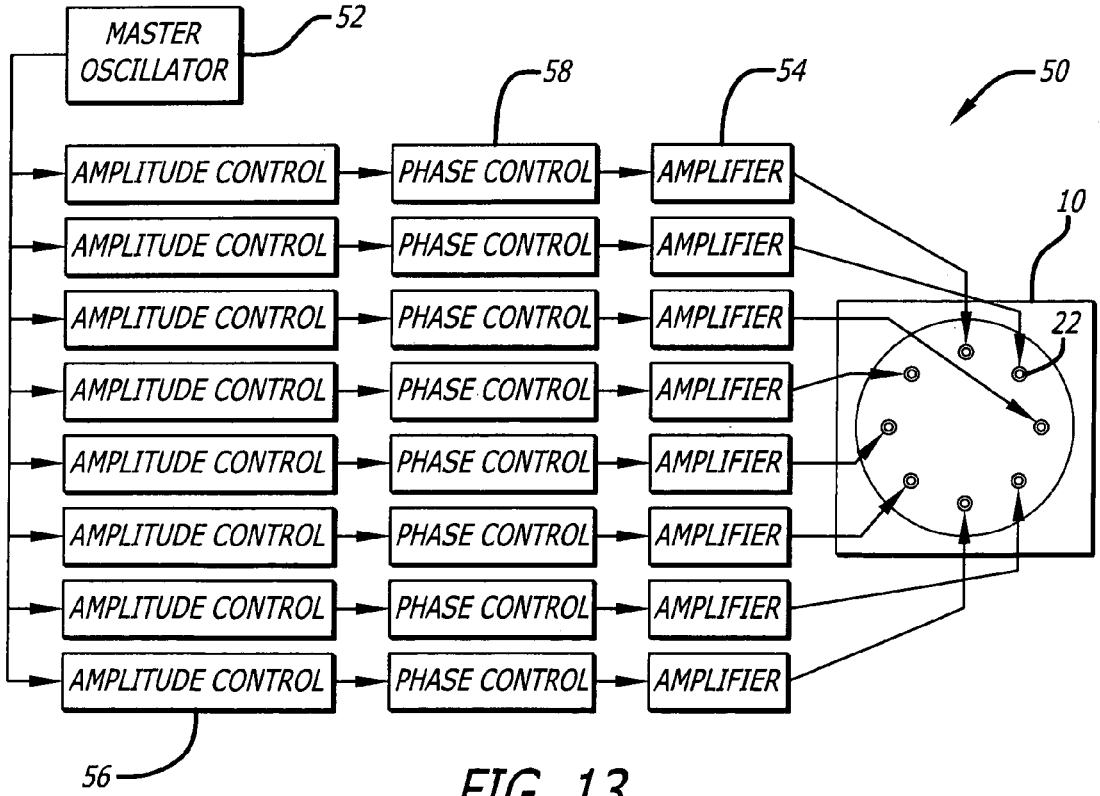
FIG. 13 is a diagram of an illustrative system for radiating high power microwave energy designed in accordance with the teachings of the present invention.

This invention requires that a means must be provided for controlling the phase and the amplitude at the input to each port of the antenna. Amplitude and phase control can be achieved by several means. FIG. 13 is a diagram of an illustrative module 50 for radiating high power microwave energy designed in accordance with the teachings of the present invention. In most cases, each port 22 of the antenna 10 will be driven by a separate microwave power amplifier 54. An amplitude control unit 56 is used to control the amplitude of the input to each amplifier 54, and a phase control unit 58 is used to control the phase of the input to each amplifier 54. The master signal amplified by each amplifier 54 may be derived from a master oscillator 52, so that the inputs to each amplitude control unit 56 are in phase. A number of different means are available for implementation of the amplitude control unit 56, including digitally-controlled variable attenuators. The phase control unit 58 can take the form of a ferrite phase shifter or a digital delay line at the input or output of each amplifier 54. It is also possible to "hard wire" the phase shifts simply by connecting the antenna 10 to the output of each amplifier 54 by using lengths of transmission line (coaxial cable, for example) cut to the length required to yield the desired phase at the input to each port 22 of the antenna 10.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. An antenna for radiating electromagnetic energy comprising:

a first dielectric substrate having opposite first and second surfaces;

a patch of conducting material disposed on said first surface;

a ground plane of conducting material disposed on said second surface; and at least three input means, each input means adapted to couple an input signal to said patch at a feed point, wherein said feed points are positioned to minimize the total power reflected from each input means.

2. The invention of claim 1 wherein said feed points are positioned such that for each input means, a directly-reflected signal from said input means is nearly cancelled by cross-coupled signals from the other input means.

3. The invention of claim 1 wherein said feed points are positioned to minimize B=SA, where B is a vector of the amplitudes of the reflected waves at each input means, S is a matrix of the S parameters of the antenna, and A is a vector of the amplitudes of the incident waves at each input means.

4. The invention of claim 1 wherein the size of said patch is chosen to minimize the total power reflected from each input means.

5. The invention of claim 1 wherein the geometry of said patch is chosen to minimize the total power reflected from each input means.

6. The invention of claim 1 wherein said patch has N-fold rotational symmetry, where N is the number of input means.

7. The invention of claim 6 wherein said feed points are equally distributed around a circle centered on the axis of symmetry of said patch.

8. The invention of claim 7 wherein the radius d of said circle is chosen to minimize the total power reflected from each input means.

9. The invention of claim 8 wherein the radius d of said circle is determined such that directly-reflected signals from each individual input means are cancelled by cross-coupled signals from the other input means.

10. The invention of claim 1 wherein said feed points are positioned such that the geometry of the antenna seen at each feed point is the same for all feed points.

11. The invention of claim 1 wherein said patch is circular.

12. The invention of claim 1 wherein said patch is in the shape of a polygon having a multiple of N sides, where N is the number of input means.

13. The invention of claim 1 wherein said input means include coaxial connectors, each connector including a center conductor connected to said patch at said feed point and an outer conductor connected to said ground plane.

14. The invention of claim 1 wherein said input means include microstrip feed lines, each microstrip line coupled to said patch at said feed point.

15. The invention of claim 14 wherein said input means further include input ports, each port coupled to a microstrip feed line.

16. The invention of claim 15 wherein said input ports are coaxial connectors.

17. The invention of claim 16 wherein the distance of the point of connection for each coaxial port from the end of the corresponding microstrip feed line is chosen to minimize the reflected power from the coaxial-to-microstrip transition.

18. The invention of claim 14 wherein said dielectric substrate includes two layers.

19. The invention of claim 18 wherein said microstrip feed lines are disposed between said two layers.

20. The invention of claim 14 wherein said antenna further includes a second dielectric substrate having opposite third and fourth surfaces.

21. The invention of claim 20 wherein said third surface is coupled to said ground plane.

22. The invention of claim 21 wherein said microstrip feed lines are disposed on said fourth surface.

23. The invention of claim 1 wherein said electromagnetic energy is microwave energy.

24. A microstrip patch antenna for radiating microwave energy comprising:

a first dielectric substrate having opposite first and second surfaces;

a patch of conducting material disposed on said first surface;

a ground plane of conducting material disposed on said second surface; and at least three input ports, each input port coupled to said patch at a feed point, wherein said feed points are positioned such that for each input port, a directly-reflected signal from said input port is nearly cancelled by cross-coupled signals from the other input ports.

25. A system for combining and radiating electromagnetic energy comprising:

first means for generating a predetermined number N of input signals, where N is greater than two; and an antenna comprising:

a first dielectric substrate having opposite first and second surfaces;

a patch of conducting material disposed on said first surface;

a ground plane of conducting material disposed on said second surface; and a predetermined number N of input ports for coupling said input signals to said patch at a predetermined number N of feed points, wherein said feed points are positioned to minimize the total power reflected from each input port.

26. The invention of claim 25 wherein said system further includes second means for controlling the polarization of the radiated signal.

27. The invention of claim 26 wherein said second means includes third means for shifting the phase of each of said input signals.

28. The invention of claim 27 wherein said second means further includes fourth means for controlling the amplitude of each of said input signals.

29. The invention of claim 28 wherein said first means includes a master oscillator for generating a master signal.

30. The invention of claim 29 wherein said first means further includes a predetermined number N of amplifiers, each amplifier adapted to receive and amplify said master signal to produce an input signal.

31. The invention of claim 30 wherein said third means includes a predetermined number N of phase shifters, each phase shifter coupled to the input or output of each amplifier.

32. The invention of claim 30 wherein said third means includes a predetermined number N of delay lines, each delay line at the input or output of each amplifier.

33. The invention of claim 30 wherein said third means includes a predetermined number N of transmission lines connecting the output of each amplifier to said antenna, wherein the length of each transmission line is chosen to yield a desired phase shift.

34. The invention of claim 30 wherein said fourth means includes a predetermined number N of amplitude control units, each amplitude control unit coupled to the input or output of each amplifier.

35. The invention of claim 27 wherein the phases of said input signals are chosen to produce a left-hand circularly-polarized radiated output wave.

36. The invention of claim 27 wherein the phases of the input signals to each port are increased in increments of 360/N degrees, proceeding from port to port in a clockwise direction.

37. The invention of claim 27 wherein the phases of said input signals are chosen to produce a right-hand circular-polarized radiated output wave.

38. The invention of claim 27 wherein the phases of the input signals to each port are increased in increments of 360/N degrees, proceeding from port to port in a counter-clockwise direction.

39. The invention of claim 28 wherein the amplitudes and phases of said input signals are chosen to produce a linearly-polarized radiated output wave.

40. The invention of claim 25 wherein said feed points are positioned such that for each input port, a directly-reflected signal from said input port is nearly cancelled by cross-coupled signals from the other input ports.

41. The invention of claim 25 wherein said feed points are positioned to minimize B=SA, where B is a vector of the amplitudes of the reflected waves at each input port, S is a matrix of the S parameters of the antenna, and A is a vector of the amplitudes of the incident waves at each input port.

42. The invention of claim 25 wherein said feed points are equally distributed around a circle having the same center as the patch.

43. The invention of claim 42 wherein the radius d of said circle is chosen to minimize the total power reflected from each input port.

44. The invention of claim 43 wherein the radius d of said circle is determined such that directly-reflected signals from each individual input port are cancelled by cross-coupled signals from the other input ports.

45. A method for combining and radiating electromagnetic energy including the steps of:

generating a predetermined number N of input signals, where N is greater than two;

coupling said input signals directly to a patch antenna with N input ports coupled to said antenna at N feed points, wherein said feed points are positioned to minimize the total power reflected from each input port;

combining the input signals in the antenna; and radiating a combined output.

46. The invention of claim 45 wherein said method further includes shifting the phase of each of said input signals to produce a left-hand circular-polarized radiated output wave.

47. The invention of claim 45 wherein said method further includes shifting the phase of each of said input signals to produce a right-hand circular-polarized radiated output wave.

48. The invention of claim 45 wherein said method further includes adjusting the amplitude and phase of each of said input signals to produce a linearly-polarized radiated output wave.

* * * * *